US009030276B2

(12) United States Patent
Nummerdor

(10) Patent No.: US 9,030,276 B2
(45) Date of Patent: May 12, 2015

(54) RF MONOBLOCK FILTER WITH A DIELECTRIC CORE AND WITH A SECOND FILTER DISPOSED IN A SIDE SURFACE OF THE DIELECTRIC CORE

(75) Inventor: Jeffrey J. Nummerdor, Rio Rancho, NM (US)

(73) Assignee: CTS Corporation, Elkhart, IN (US)

( * ) Notice: Subject to any disclaimer, the term of this patent is extended or adjusted under 35 U.S.C. 154(b) by 188 days.

(21) Appl. No.: 13/604,899

(22) Filed: Sep. 6, 2012

(65) Prior Publication Data

US 2012/0326806 A1 Dec. 27, 2012

Related U.S. Application Data

(63) Continuation-in-part of application No. 12/586,013, filed on Sep. 16, 2009, now Pat. No. 8,269,579, and a continuation-in-part of application No. 12/316,233, filed on Dec. 9, 2008, now Pat. No. 8,261,714.

(51) Int. Cl.
*H01P 1/205* (2006.01)

(52) U.S. Cl.
CPC ..... *H01P 1/2056* (2013.01)

(58) Field of Classification Search
CPC ..... H01P 1/2056; H01P 1/2053; H01P 1/205
USPC ..... 333/202, 206
See application file for complete search history.

(56) References Cited

U.S. PATENT DOCUMENTS

| | | | | |
|---|---|---|---|---|
| 4,673,902 | A | | 6/1987 | Takeda et al. |
| 4,737,746 | A | | 4/1988 | Ueno |
| 4,757,288 | A | | 7/1988 | West |
| 4,937,542 | A | | 6/1990 | Nakatuka |
| 5,079,528 | A | | 1/1992 | Yorita et al. |
| 5,144,269 | A | | 9/1992 | Itoh |
| 5,157,365 | A | | 10/1992 | Hoang |
| 5,177,458 | A | | 1/1993 | Newell et al. |
| 5,191,305 | A | | 3/1993 | Frost et al. |
| 5,208,566 | A | | 5/1993 | Kenoun et al. |
| 5,214,398 | A | | 5/1993 | Hayashi |
| 5,227,747 | A | | 7/1993 | Komazaki et al. |
| 5,239,280 | A | | 8/1993 | Noguchi et al. |
| 5,254,962 | A | | 10/1993 | Morris et al. |
| 5,298,873 | A | * | 3/1994 | Ala-Kojola ..... 333/235 |
| 5,345,202 | A | | 9/1994 | Kobayashi et al. |
| 5,486,799 | A | | 1/1996 | Komazaki et al. |
| 5,512,866 | A | | 4/1996 | Vangala et al. |
| 5,563,561 | A | | 10/1996 | Ishihara et al. |
| 5,572,175 | A | | 11/1996 | Tada et al. |
| 5,602,518 | A | | 2/1997 | Clifford, Jr. et al. |

(Continued)

FOREIGN PATENT DOCUMENTS

| | | |
|---|---|---|
| EP | 0 364 931 | 4/1990 |
| EP | 0 520 673 | 12/1992 |

(Continued)

*Primary Examiner* — Benny Lee

(74) *Attorney, Agent, or Firm* — Daniel J. Deneufbourg

(57) ABSTRACT

An RF filter assembly comprising two filters. In one embodiment, the RF filter assembly comprises a core of dielectric material including a plurality of through-holes and a surface-layer pattern of conductive areas on a top surface of the core that define a first RF filter and a second RF low pass filter is defined, and extends between respective conductive input/output electrodes, on a wall that protrudes outwardly and upwardly from a top surface of the RF filter assembly.

9 Claims, 8 Drawing Sheets

(56) References Cited

U.S. PATENT DOCUMENTS

| | | | |
|---|---|---|---|
| 5,686,873 | A | 11/1997 | Tada et al. |
| 5,731,751 | A | 3/1998 | Vangala |
| 5,783,978 | A | 7/1998 | Noguchi et al. |
| 5,793,267 | A | 8/1998 | Tada et al. |
| 5,896,073 | A | 4/1999 | Miyazaki et al. |
| 5,959,511 | A | 9/1999 | Pasco et al. |
| 6,023,207 | A | 2/2000 | Ito et al. |
| 6,052,040 | A | 4/2000 | Hino |
| 6,204,738 | B1 | 3/2001 | Toda et al. |
| 6,236,288 | B1 | 5/2001 | Tsujiguchi |
| 6,313,797 | B1 | 11/2001 | Kurita et al. |
| 6,498,542 | B1 | 12/2002 | Kuroda et al. |
| 6,570,473 | B2 | 5/2003 | Endo et al. |
| 6,737,943 | B2 | 5/2004 | Takubo et al. |
| 6,765,457 | B2 | 7/2004 | Tada et al. |
| 2001/0052832 | A1 | 12/2001 | Gotoh et al. |
| 2002/0109562 | A1 | 8/2002 | Tsukamoto et al. |
| 2002/0190818 | A1 | 12/2002 | Endou et al. |
| 2003/0151468 | A1 | 8/2003 | Vangala et al. |
| 2009/0146761 | A1 | 6/2009 | Nummerdor |

FOREIGN PATENT DOCUMENTS

| | | |
|---|---|---|
| EP | 0 865 094 | 9/1998 |
| EP | 0 951 089 | 10/1999 |
| EP | 0 999 606 | 5/2000 |
| GB | 2 210 225 | 6/1989 |
| JP | 61 004303 | 1/1986 |
| JP | 61 258502 | 11/1986 |
| JP | 62 252202 | 11/1987 |
| JP | 01 097002 | 4/1989 |
| JP | 2-101603 | 8/1990 |
| JP | 03 239001 | 10/1991 |
| JP | 404242301 | 8/1992 |
| JP | 405167308 | 7/1993 |
| JP | 405275905 | 10/1993 |
| JP | 406216607 | 8/1994 |
| JP | 2005 191983 | 7/2005 |
| JP | 2005191983 | 7/2005 |
| WO | WO 95/30250 | 11/1995 |
| WO | WO 2009/075833 | 6/2009 |

* cited by examiner

FIGURE 8
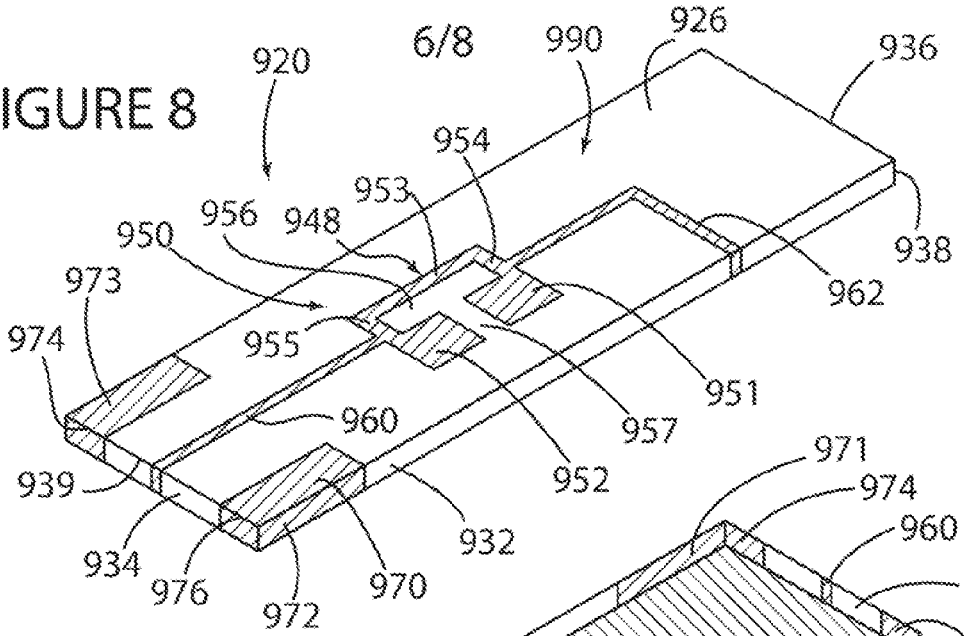
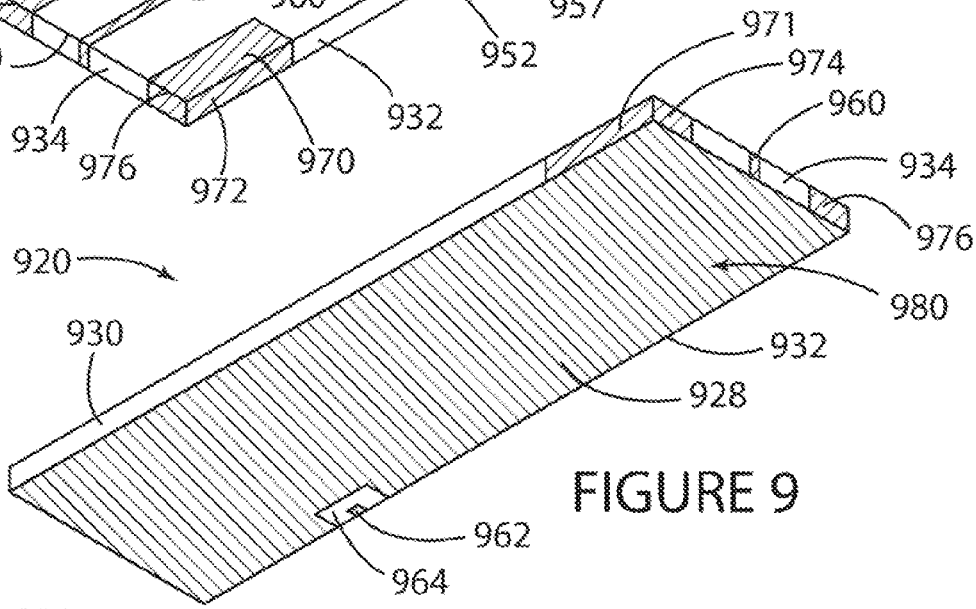
FIGURE 9
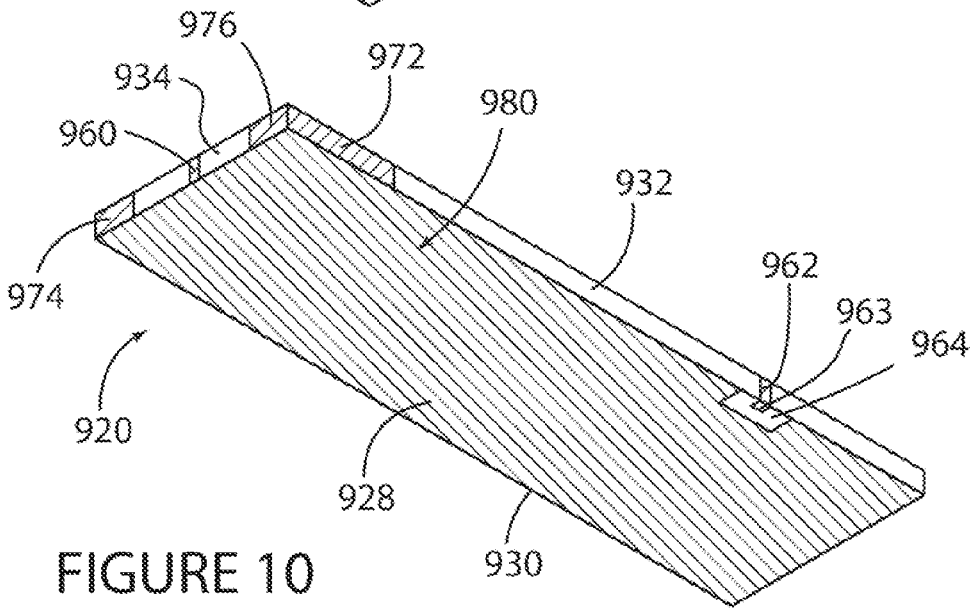
FIGURE 10

RF MONOBLOCK FILTER WITH A DIELECTRIC CORE AND WITH A SECOND FILTER DISPOSED IN A SIDE SURFACE OF THE DIELECTRIC CORE

CROSS-REFERENCE TO RELATED AND CO-PENDING APPLICATIONS

This application is a continuation-in-part application of, and claims the benefit of the filing date and disclosure of, U.S. patent application Ser. No. 12/586,013 filed on Sep. 16, 2009 now U.S. Pat. No. 8,269,579 issued on Sep. 18, 2012 and U.S. patent application Ser. No. 12/316,233 filed on Dec. 9, 2008 now U.S. Pat. No. 8,261,714 issued on Sep. 11, 2012 which are explicitly incorporated herein by reference as are all references cited therein.

TECHNICAL FIELD

This invention relates to dielectric block filters for radio-frequency signals, and, in particular, to monoblock passband filters.

BACKGROUND OF THE INVENTION

Ceramic block filters offer several advantages over lumped component filters. The blocks are relatively easy to manufacture, rugged, and relatively compact. In the basic ceramic block filter design, the resonators are formed by typically cylindrical passages, called through-holes, extending through the block from the long narrow side to the opposite long narrow side. The block is substantially plated with a conductive material (i.e. metallized) on all but one of its six (outer) sides and on the inside walls formed by the resonator through-holes.

One of the two opposing sides containing through-hole openings is not fully metallized, but instead bears a metallization pattern designed to couple input and output signals through the series of resonators. This patterned side is conventionally labeled as the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1980s, efforts at improvement on this basic design have continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices and longer battery life. Combined, these trends place difficult constraints on the design of wireless components such as filters. Filter designers may not simply add more space-taking resonators or allow greater insertion loss in order to provide improved signal rejection.

A specific challenge in RF filter design is providing sufficient attenuation (or suppression) of signals that are outside the target passband at frequencies which are integer multiples of the frequencies within the passband. The label applied to such integer-multiple frequencies of the passband is a "harmonic." Providing sufficient signal attenuation at harmonic frequencies has been a persistent challenge.

SUMMARY OF THE INVENTION

The present invention is directed generally to a filter adapted to be mounted to a substrate which comprises a core of dielectric material including a top surface with a first pattern of areas of conductive material, first and second opposed side surfaces, and third and fourth opposed side surfaces which extend between the ends of the first and second opposed side surfaces respectively; a plurality of through-holes which extend through the core and define a plurality of respective openings in the top surface, the first pattern of areas of conductive material on the top surface surrounding at least a portion of one or more of the openings in the top surface; at least first and second walls which protrude outwardly from the top surface, each of the first and second walls including an inner surface, an outer surface, and a top rim, the first and second walls defining respective first and second shields which prevent external electromagnetic fields from causing noise and interference; a first conductive input/output electrode on the first wall and in contact with the first pattern of areas of conductive material on the top surface of the core; a second conductive input/output electrode on the first or second wall; a first filter defined in part by the first pattern of areas of conductive material on the top surface of the core; and a second filter on one or more of the side surfaces of the core.

In one embodiment, the filter further comprises a third conductive input/output electrode on the first or second wall and in contact with the first pattern of areas of conductive material on the top surface of the core, the second filter being defined by a second pattern of areas of conductive material including a first end coupled to the third conductive input/output electrode and a second end coupled to the second conductive input/output electrode.

In one embodiment, each of the first, second, and third conductive input/output electrodes is defined by respective first, second, and third regions of conductive material formed on respective first, second, and third posts of dielectric material defined by respective first, second, and third pairs of slots in the first or second walls.

In one embodiment, the second and third conductive input/output electrodes are formed on the first wall, the second conductive input/output electrode are located on the first wall between the first and third conductive input/output electrodes, and the second pattern of areas of conductive material define the second filter formed on an exterior surface of the first wall and extending between the second and third conductive input/output electrodes.

In one embodiment, each of the first, second, and third conductive input/output electrodes is defined by respective first, second, and third regions of conductive material formed on respective first, second, and third posts of dielectric material defined by respective first, second, and third pairs of slots in the first and second walls.

In another embodiment, a filter is adapted to be mounted to a substrate and comprises a core of dielectric material which includes a top surface with a first pattern of areas of conductive material, first and second opposed and longitudinally extending side surfaces, and third and fourth opposed side surfaces which extend transversely between the ends of the first and second opposed side surfaces respectively; a plurality of through-holes extends through the core and defines a plurality of respective openings in the top surface, the first pattern of areas of conductive material on the top surface surrounding at least a portion of one or more of the openings in the top surface; at least first and second walls protrude outwardly from the top surface and extend longitudinally along the first and second side surfaces respectively, each of the first and second walls including an inner surface, an outer surface, and a top rim; a first conductive input/output electrode is defined by a first strip of conductive material on the first wall and in contact with the first pattern of areas of conductive material on the top surface of the core; a second conductive input/output electrode is defined by a second strip of conductive material on the first or second wall; a third conductive input/output electrode is defined by a third strip of conductive material on the first or second wall with the second conductive input/output electrode; a first filter is defined in part by the first pattern of areas of conductive material on the top surface; and a second filter is defined by a second pattern of areas of conductive material on an exterior surface of the first or second wall with the second and third conductive input/output electrodes, the second pattern of areas of conductive material including a first end coupled to the second conductive input/output electrode and a second end coupled to the third conductive input/output electrode.

In one embodiment, the first, second, and third conductive input/output electrodes is defined by respective first, second, and third posts defined by respective first, second, and third pairs of slots formed in the first or second walls, the first, second, and third strips of conductive material being formed on the respective first, second, and third posts.

In one embodiment, the first, second, and third input/output electrodes and the second filter are all located on the first wall and the second input/output electrode is located between the first and third input/output electrodes.

In yet another embodiment, a filter is adapted to be mounted to a substrate and comprises a core of dielectric material which includes a top surface with a first surface-layer pattern of areas of conductive material, first and second opposed and longitudinally extending side surfaces, and third and fourth opposed side surfaces which extend transversely between the ends of the first and second opposed side surfaces respectively; a plurality of through-holes which extend through the core and define a plurality of respective openings in the top surface, the first surface-layer pattern of areas of conductive material on the top surface surrounding at least a portion of one or more of the openings in the top surface; at least first and second longitudinally extending walls protrude outwardly from the top surface in a relationship generally co-planar with the first and second side surfaces respectively, each of the first and second walls including an inner surface, an outer surface, and a top rim; a first conductive input/output electrode is defined by a first post of dielectric material defined between a first pair of slots in the first wall and including a first surface-layer trip of conductive material in contact with the first surface-layer pattern of areas conductive material on the top surface of the core; a second conductive input/output electrode is defined by a second post of dielectric material defined between a second pair of slots defined in the first wall and includes a surface-layer strip of conductive material; a third conductive input/output electrode is defined by a third post of dielectric material defined between a third pair of slots defined in the first wall and includes a third surface-layer strip of conductive material in contact with the first pattern of areas of conductive material on the top surface of the core; a first filter is defined in part by the first pattern of areas of conductive material on the top surface; and a second filter is defined by a second surface-layer pattern of areas of conductive material on an exterior surface of the first wall, the second pattern of areas of conductive material including a first end coupled to the second conductive input/output electrode and a second end coupled to the third conductive input/output electrode.

There are other advantages and features of this invention, which will be more readily apparent from the following detailed description of the embodiments of the invention, the drawings, and the appended claims.

BRIEF DESCRIPTION OF THE FIGURES

In the accompanying drawings that form part of the specification, and in which like numerals are employed to designate like parts throughout the same:

FIG. 8 is an enlarged front side perspective view of another embodiment of the lid filter of the present invention;

FIG. 9 is an enlarged bottom side perspective view of the lid filter shown in FIG. 8;

FIG. 10 is another enlarged bottom side perspective view of the lid filter shown in FIG. 8;

DETAILED DESCRIPTION OF THE EMBODIMENTS

Figure 1:
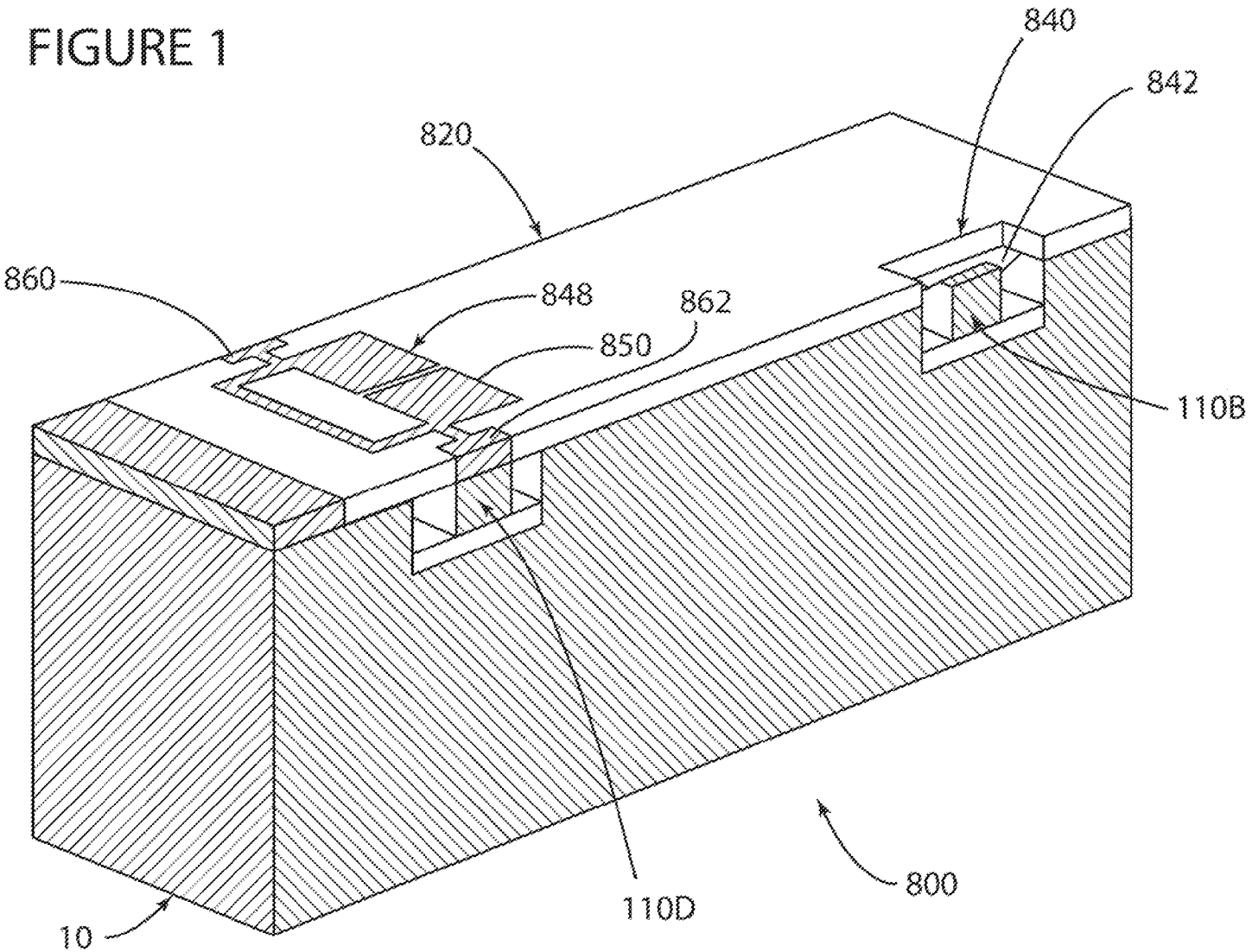
FIG. 1 is an enlarged front side perspective view of a monoblock filter with a low pass lid filter according to the present invention.
Figure 2:
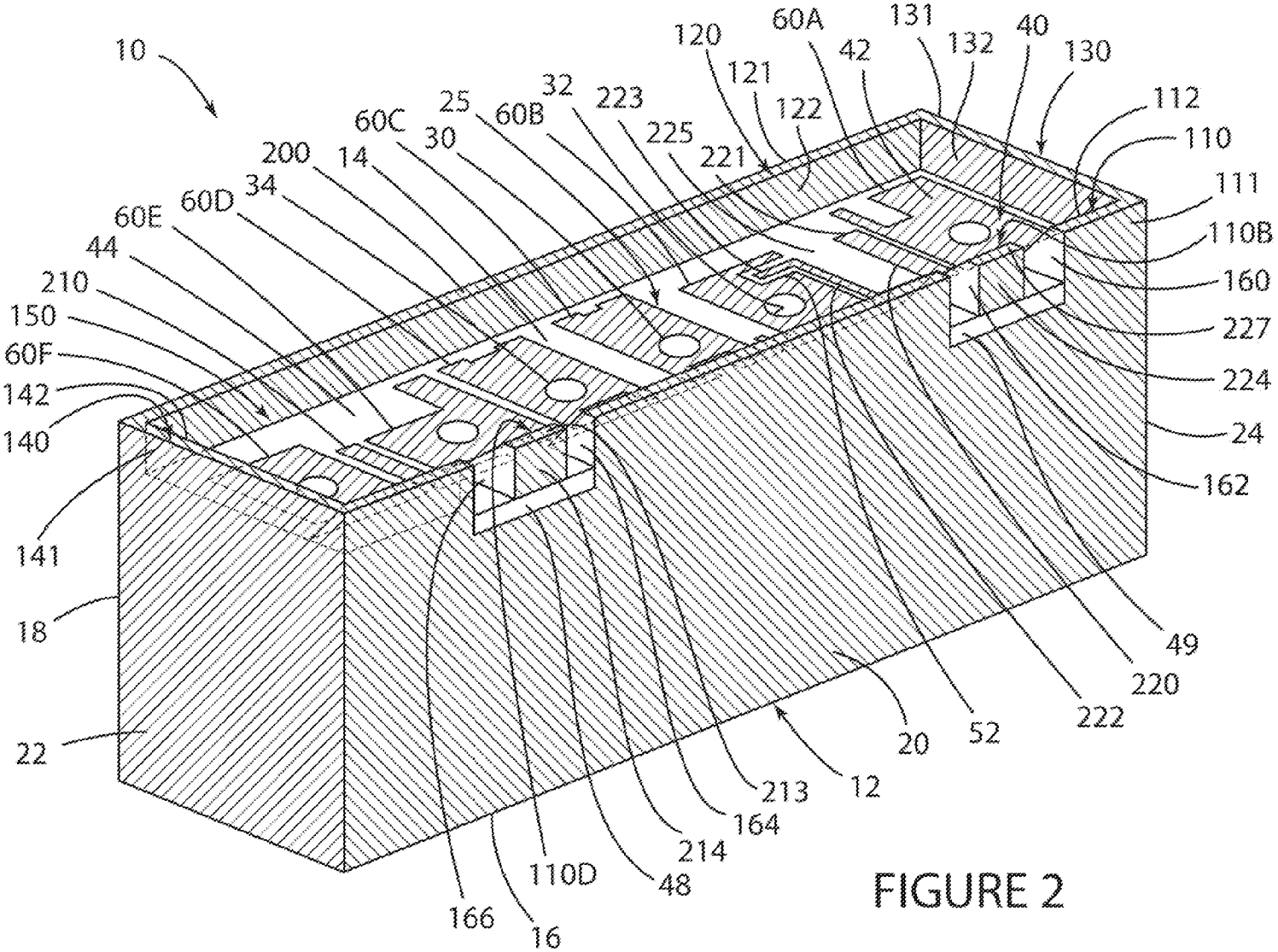
FIG. 2 is an enlarged front side perspective view of the monoblock filter of FIG. 1 without the lid filter.
Figure 3:
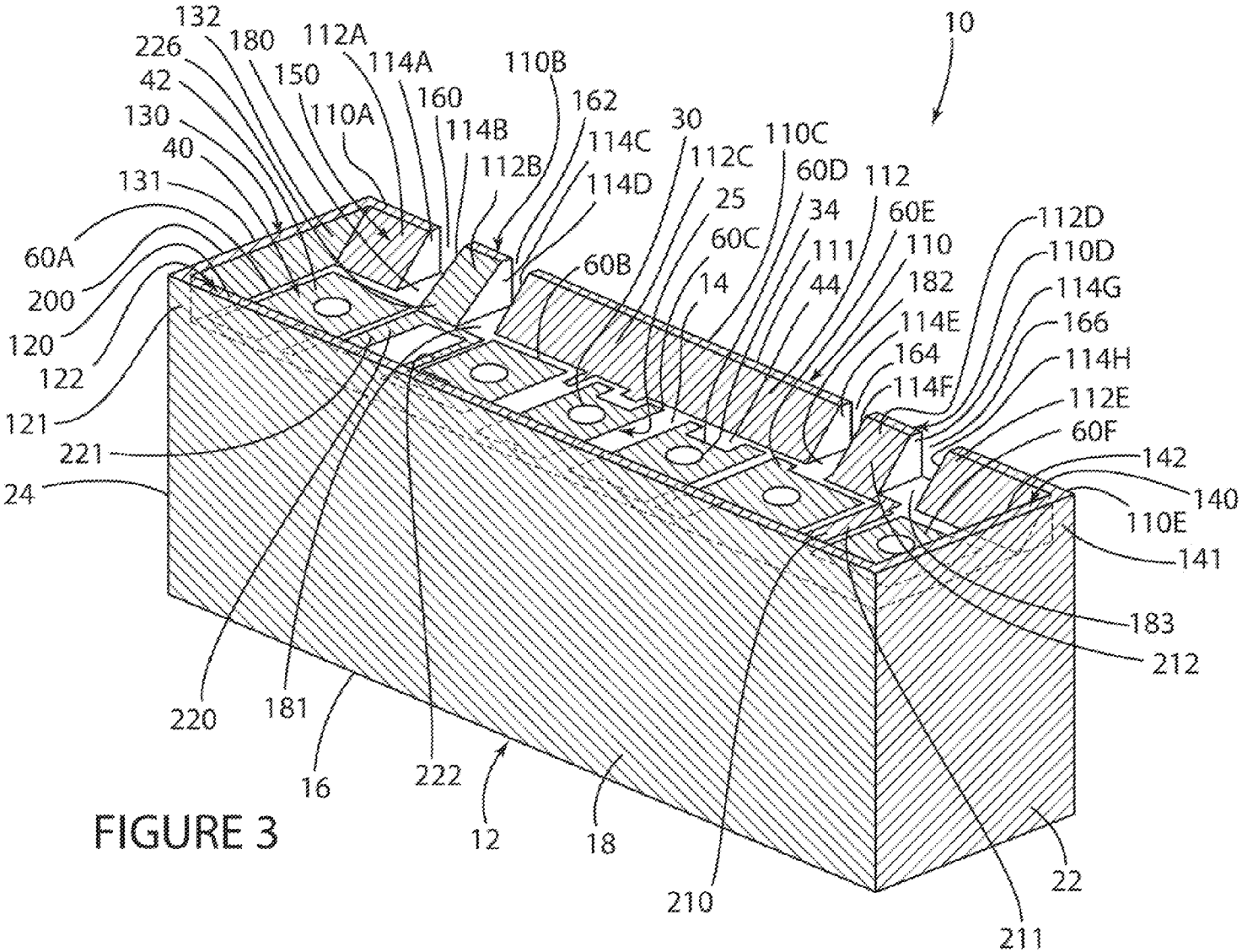
FIG. 3 is an enlarged back side perspective view of the monoblock filter of FIG. 1 without the lid filter.

While this invention is susceptible to embodiment in many different forms, this specification and the accompanying drawings disclose a composite RF filter assembly generally designated 800 in FIG. 1 which comprises a monoblock filter 10 as shown in FIGS. 1-3 (i.e., the first filter of the filter assembly 800) and a lid 820 (FIGS. 1, 4, 5, 6) or 920 (FIGS. 8, 9, 10) (i.e., the second filter of the filter assembly 800) seated and coupled to the top of the filter 10.

Filter 10 is currently the subject of co-pending U.S. patent application Ser. No. 12/316,233 filed on Dec. 9, 2008 now U.S. Pat. No. 8,261,714 issued on Sep. 11, 2012 and thus the disclosure and contents thereof are expressly incorporated herein by reference.

Filter 10 as shown in FIGS. 2 and 3 comprises a generally elongate, parallelepiped or box-shaped rigid block or core comprised of a ceramic dielectric material 12 having a desired dielectric constant. In one embodiment, the dielectric material can be a barium or neodymium ceramic with a dielectric constant of about 37 or above. Core 12 (FIGS. 2 and 3) defines an outer surface with six generally rectangular sides: a top side or top surface 14; a bottom side or bottom surface 16 that is parallel to and diametrically opposed from top surface 14; a first side or side surface 18; a second side or side surface 20 (FIG. 2) that is parallel to and diametrically opposed from side surface 18; a third side or end surface 22; and a fourth side or end surface 24 that is parallel to and diametrically opposed from end surface 22.

Core 12 additionally defines four generally planar walls 110, 120, 130 and 140 of ceramic dielectric material unitary with the ceramic dielectric material of core 12 that extend upwardly and outwardly away from the respective outer peripheral edges of the top surface 14 thereof. Walls 110, 120, 130, 140 and top surface 14 together define a cavity 150 in the top of the filter 10. Walls 110, 120, 130, 140 further together define a peripheral top rim 200 at the top of the walls.

Longitudinal walls 110 and 120 are parallel and diametrically opposed to each other. Transverse walls 130 and 140 are parallel and diametrically opposed to each other.

Wall 110 has an outer surface 111 and an inner surface 112. Outer surface 111 is co-extensive and co-planar with side surface 20 while inner surface 112 slopes or angles outwardly and downwardly away from the rim 200 into top surface 14 to define a surface which is sloped at approximately a 45 degree angle relative to both the top surface 14 and the wall 110. Other slope angles may be used. Walls 120, 130 and 140 all define generally vertical outer walls generally co-planar with the respective core side surfaces and generally vertical inner walls.

Wall 110 additionally defines a plurality of generally parallel and spaced-apart slots 160, 162, 164 and 166 that extend through wall 110 in an orientation generally normal to top surface 14.

An end wall portion 110A (FIG. 3) is defined between the wall 130 and slot 160. A wall portion or post 110B of ceramic dielectric material unitary with the ceramic dielectric material of core 12 is defined between spaced-apart slots 160 and 162 and extends upwardly and outwardly away from the outer peripheral edge of the top surface 14 of filter 10. Wall portion 110C (FIG. 3) is defined between slots 162 and 164. A wall portion or post 110D of ceramic dielectric material unitary with the ceramic dielectric material of core 12 is defined between slots 164 and 166 and extends upwardly and outwardly away from the outer peripheral edge of the top surface 14 of filter 10. Post 110D is diametrically opposed to post 110B and is defined in an end portion of wall 110 adjacent the wall 140. An end wall portion 110E (FIG. 3) is defined between the wall 140 and slot 166.

Inner surface 112 is further separated into several portions including inner angled or sloped surface portions 112A, 112B, 112C, 112D and 112E (FIG. 3). Inner surface portion 112A is located on wall portion 110A. Inner surface portion 112B is located on wall portion or post 110B. Inner surface portion 112C is located on wall portion 110C. Inner surface portion 112D is located on wall portion or post 110D. Inner surface portion 112E is located on wall portion 110E.

As shown in FIG. 3, wall portions 110A, 110B, 110C, 110D, and 110E further define generally triangularly-shaped side walls. Specifically, wall portion 110A defines a side wall 114A adjacent to slot 160. Post 110B defines a side wall 114B adjacent to slot 160 and an opposed side wall 114C adjacent to slot 162. Wall portion 110C defines a side wall 114D adjacent to slot 162 and an opposed side wall 114E adjacent to slot 164. Post 110D defines a side wall 114F adjacent to slot 164 and a side wall 114G adjacent to slot 166. Wall portion 110E defines a side wall 114H adjacent to slot 166.

Wall 120 has an outer surface 121 and an inner surface 122. Outer surface 121 is co-extensive and co-planar with side 18 and inner surface 122 is perpendicular to top surface 14.

Wall 130 has an outer surface 131 and an inner surface 132. Outer surface 131 is co-extensive and co-planar with side 22 and inner surface 132 is perpendicular to top surface 14.

Wall 140 has an outer surface 141 and an inner surface 142. Outer surface 141 is co-extensive and co-planar with side 24 and inner surface 142 is perpendicular to top surface 14.

Top surface 14 can have several portions that are located and extend between the slots of wall 110. Top surface portion 180 (FIG. 3) forms the base of slot 160 and is located between wall portions 114A and 114B. Top surface portion 181 (FIG. 3) forms the base of slot 162 and is located between wall portions 114C and 114D. Top surface portion 182 (FIG. 3) forms the base of slot 164 and is located between wall portions 114E and 114F. Top surface portion 183 (FIG. 3) forms the base of slot 166 and is located between wall portions 114G and 114H.

The filter 10 has a plurality of resonators 25 (FIGS. 2 and 3) defined in part by a plurality of metallized through-holes. Specifically, resonators 25 take the form of through-holes 30 (FIGS. 2 and 3) which are defined in dielectric core 12. Through-holes 30 extend from and terminate in openings 34 (FIGS. 2 and 3) in top surface 14 and openings (not shown) in bottom surface 16. Through-holes 30 are aligned in a spaced-apart, co-linear relationship in block 12 such that through-holes 30 are equal distances from sides 18 and 20. Each of through-holes 30 is defined by an inner cylindrical metallized side-wall surface.

Top surface 14 of core 12 additionally defines a surface-layer recessed pattern 40 (FIGS. 2 and 3) of electrically conductive metallized and insulative unmetallized areas or patterns. Pattern 40 is defined on the top surface 14 of core 12 and thus defines a recessed filter pattern by virtue of its recessed location at the base of cavity 150 in spaced relationship from and with the top rim 200 of walls 110, 120, 130, and 140.

The metallized areas are preferably a surface layer of conductive silver-containing material. Recessed pattern 40 also defines a wide area or pattern of metallization 42 (FIGS. 2 and 3) that covers at least bottom surface 16, side surfaces 18, 22 and 24, and the outside surfaces 111, 121, 131, and 141 and top rim 200 of each of the walls 110, 120, 130, and 140. Wide area of metallization 42 also covers a portion of top surface 14 and side surface 20 and the interior side walls of through-holes 30. Metallized area 42 extends contiguously from within resonator through-holes 30 towards both top surface 14 and bottom surface 16. Metallization area 42 may also be labeled a ground electrode. Area 42 serves to absorb or prevent transmission of off-band signals. A more detailed description of recessed pattern 40 on top surface 14 follows.

For example, a portion of metallized area 42 is present in the form of resonator pads 60A, 60B, 60C, 60D, 60E and 60F (FIGS. 2 and 3) which surround respective through-hole openings 34 defined on top surface 14. Resonator pads 60A-60F are contiguous or connected with metallization area 42 that extends through the respective inner surfaces 32 (FIG. 2) of through-holes 30. Resonator pads 60A-60F at least partially surround the respective openings 34 of through-holes 30. Resonator pads 60A-60F are shaped to have predetermined capacitive couplings to adjacent resonators and other areas of surface-layer metallization.

An unmetallized area or pattern 44 (FIGS. 2 and 3) extends over portions of top surface 14 and portions of side surface 20. Unmetallized area 44 surrounds all of the metallized resonator pads 60A-60F.

Unmetallized area 44 extends onto top surface slot portions 180, 181, 182 and 183 (FIG. 3). Unmetallized area 44 also extends onto side wall slot portions 114A, 114B, 114C, 114D, 114E, 114F, 114G and 114H (FIG. 3). Side wall slot portions 114A and 114B define the opposed side walls of post 110B. Side wall slot portions 114F and 114G define the opposed side walls of posts 110D.

Unmetallized area 44 also defines an unmetallized area 49 (FIG. 2) which extends onto a portion of side surface 20 located below post 110B and slots 160 and 162 in a generally rectangular shape. A similar unmetallized area 48 (FIG. 2) extends onto a portion of side surface 20 located below post 110D and slots 164 and 166 in a generally rectangular shape. Unmetallized areas 44, 48 and 49 are co-extensive or joined or coupled with each other in an electrically non-conducting relationship.

Surface-layer recessed pattern 40 additionally defines a pair of isolated metallized areas or strips for input and output connections to filter 10. An input connection area or strip or electrode 210 (FIGS. 2 and 3) and an output connection area or strip or electrode 220 (FIGS. 2 and 3) are defined on top surface 14 and extend onto a portion of wall 110 and side surface 20 and, more specifically, onto the inner, rim, and outer portions of respective input and output posts 110D and 110B where they can serve as surface mounting connection points as described in more detail below. Electrode 210 is located adjacent and parallel to filter side surface 22 while electrode 220 is located adjacent and parallel to filter side surface 24.

Elongated input connection area of metallization or electrode 210 is located adjacent side surface 22. Input connection area or electrode 210 includes electrode portions 211 (FIG. 3), 212 (FIG. 3), 213 (FIG. 2) and 214 (FIG. 2). Electrode portion 211 is located between resonator pads 60E and 60F and connects with electrode portion 212 that is located on inner surface portion 112D of post 110D. Electrode portion 212 connects with electrode portion 213 that is located on the top rim portion of post 110D. Electrode portion 213 connects with electrode portion 214 that is located on the outer surface 111 of post 110D. Electrode portion 214 is surrounded on all sides by unmetallized areas 44 and 48 (FIGS. 2 and 3).

Generally Y-shaped output connection area of metallization or electrode 220 is located adjacent side surface 24. Output connection area or electrode 220 includes electrode portions 221, 222, 223 (FIG. 2) and 224 (FIG. 2), 226 (FIG. 3) and 227 (FIG. 2). Electrode portion or finger 221 is located between resonator pads 60A and 60B, extends in a generally parallel relationship to side 24 and connects with electrode portion 226 that is located on inner surface portion 112B of post 110B. Electrode portion 226 connects with electrode portion 227 that is located on the top rim portion of post 110B. Electrode portion 227 connects with electrode portion 224 that is located on the outer surface 111 of post 110B. Electrode portion 224 is surrounded on all sides by unmetallized areas 44 and 49 (FIG. 2).

Another electrode portion 222 (FIGS. 2 and 3) is located between resonator pads 60A and 60B and extends in a generally parallel relationship to side 24. Electrode portion 222 is L-shaped and connects with electrode finger 223 (FIG. 2) that extends into a U-shaped unmetallized area 52 (FIG. 2) that is substantially surrounded by resonator pad 608. An unmetallized area 225 (FIG. 2) is located between electrode portions 221 and 222.

Lid Filter

FIGS. 1 and 4-6 depict one embodiment of the lid, cover or plate filter 820 in accordance with the present invention which is mounted to monoblock filter 10 to form a composite RF filter assembly 800 (FIG. 1) with improved attenuation and signal rejection characteristics when compared to the performance of filter 10 alone.

Lid filter 820 comprises a generally elongate, parallelepiped or flat shaped rigid slab or plate comprised of a ceramic dielectric material having a desired dielectric constant. In one embodiment, the dielectric material can be a barium or neodymium ceramic with a dielectric constant of about 12 or above. Lid filter 820 defines an outer surface with six generally rectangular sides: a top side or top surface 826 (FIGS. 4 and 5); a bottom side or bottom surface 828 (FIG. 6) that is parallel to and diametrically opposed from top surface 826; a first side or side surface 830 (FIG. 5); a second side or side surface 832 (FIGS. 4 and 6) that is parallel to and diametrically opposed from side surface 830; a third side or end surface 834 (FIGS. 4, 5, and 6); and a fourth side or end surface 836 (FIG. 4) that is parallel to and diametrically opposed to end surface 834. Plate 820 and the respective side surfaces thereof additionally define a plurality of vertical peripheral edges 838 (FIG. 4) and a plurality of horizontal peripheral edges 839 (FIG. 4).

A generally rectangularly-shaped recess or groove 840 is defined in side 832 (FIGS. 4 and 6) and is located adjacent side surface 836. Recess 840 separates lid 820 from post 110B (FIG. 1) and defines a gap 842 (FIG. 1) around post 110B.

Figure 4:
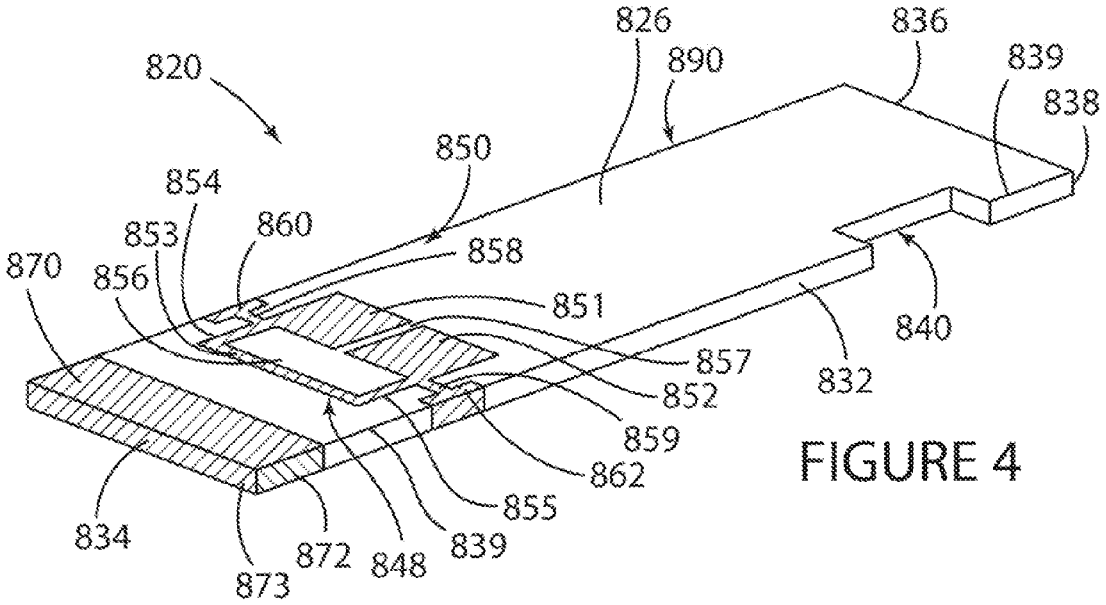
FIG. 4 is an enlarged front side perspective view of the lid filter shown in FIG. 1.

A low pass filter 848 (FIGS. 1, 4, and 5) is defined on top surface 826 of plate 820 by a surface-layer pattern 850 of electrically conductive metallized and insulative unmetallized areas or patterns (FIGS. 1 and 4).

The metallized areas are preferably a surface layer of conductive silver-containing material. Pattern 850 is defined in part by generally square-shaped metallized pads 851 and 852 (FIGS. 4 and 5) that are located on a portion of top surface 826 adjacent side surface 834. Pads 851 and 852 are spaced from each other and separated by an unmetallized slot or region 857 (FIG. 4). A plurality of strips of conductive material define arms 853, 854 and 855 (FIG. 4) that form a C-shape and connect pads 851 and 852 to each other. Arm 854 is connected to pad 851 and arm 855 is connected to pad 852. Arm 853 is connected between arms 854 and 855. A generally rectangularly-shaped unmetallized area or region 856 (FIG. 4) is defined in the interior region bounded by arms 853, 854, 855 and pads 851 and 852. Region 856 is contiguous and perpendicular to region 857 and together define a generally T-shaped unmetallized region or area.

Figure 5:
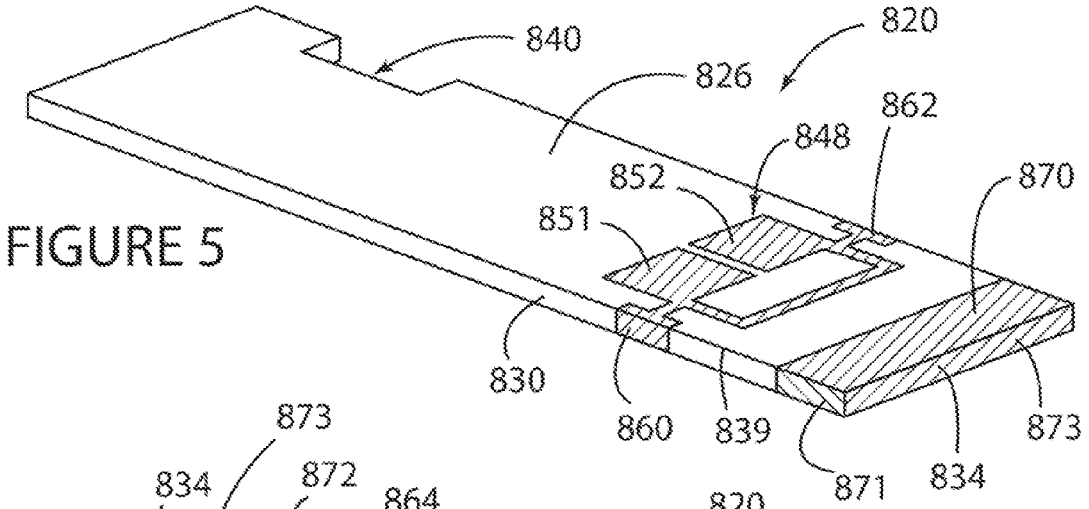
FIG. 5 is an enlarged back side perspective view of the lid filter shown in FIG. 4.

A strip or line of metallization 858 (FIG. 4) connects the pad 851 to a metallized connection pad 860 (FIGS. 1, 4, and 5). Connection pad 860 extends partially on top surface 826; wraps over the back horizontal edge 839 onto side surface 830 (FIG. 5); and connects to a wide area of metallization 880 (FIG. 6) on the bottom surface 828 of lid filter 820.

Figure 6:
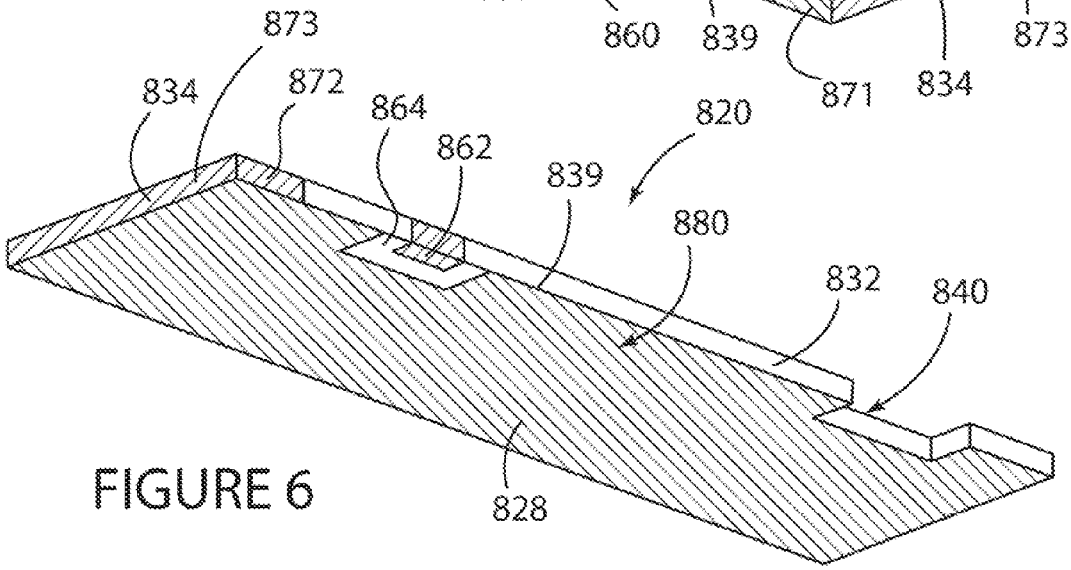
FIG. 6 is an enlarged bottom side perspective of the lid filter shown in FIG. 4.

A strip or line of metallization 859 (FIG. 4) connects pad 852 to metallized connection pad 862 (FIGS. 1, 4, 5 and 6). Connection pad 862 extends partially on top surface 826; wraps over front horizontal edge 839 onto side 832 and then onto bottom surface 828 (FIG. 6) to define a conductive RF signal input/output connection pad on the bottom surface 828 which is surrounded by a generally U-shaped unmetallized area 864 (FIG. 6).

As described above, pattern 850 defines a wide area or pattern of metallization 880 (FIG. 6) that covers all of bottom surface 828 except for the area 864 surrounding connection pad 862. Wide area or pattern of metallization 880 also covers a portion of top surface 826 and side surfaces 830, 832 and 834.

More specifically, wide area of metallization 880 comprises: a rectangularly-shaped metallized area 870 (FIGS. 4 and 5) adjacent side surface 834 that covers a portion of top surface 826 adjacent end side surface 834; a metallized area 871 (FIG. 5) that covers a portion of side surface 830 (FIG. 5) adjacent end side surface 834; a metallized area 872 (FIGS. 4 and 6) that covers a portion of side surface 832 adjacent side surface 834; and a metallized area 873 (FIGS. 4, 5 and 6) that covers the entirety of end side surface 834.

Pattern 850 further includes an unmetallized area 890 (FIG. 4) that extends over portions of top surface 826, bottom surface 828, and at least portions of side surfaces 830, 832, and 836.

Referring back to FIGS. 1, 2, and 6, lid filter 820 is mounted to filter 10 (FIGS. 1 and 2) such that lid 820 (FIG. 1) covers cavity 150 (FIG. 2). Specifically, lid 20 is mounted on top of the walls 110, 120, 130, and 140 (FIG. 2) and, more specifically, the peripheral circumferential edge of the bottom surface 828 (FIG. 6) of lid filter 820 is supported and seated on the rim 200 of walls 110, 120, 130 and 140 in a relationship spaced from and parallel to the top surface 14 (FIG. 2) of filter 10.

Because rim 200 is metallized and portions of bottom surface 828 are covered by wide area of metallization 880 (FIG. 6), lid filter 820 can be attached to filter 10 by the use of a solder material. Solder can be screen printed onto portions of the lid filter 820, placed onto the rim 200, and then reflowed in an oven to connect the lid 820 to filter 10.

Solder can also be placed onto connection pad 862 (FIG. 6) on bottom surface 828 of the lid filter 820. Connection pad 862 is seated on the top rim portion of the post 110D (FIG. 2) and connected to the top rim portion 213 (FIG. 2) of the electrode 214 (FIG. 2) thereon and then reflowed to make an electrical connection between the connection pad 862 and electrode 214 and thus between the low pass filter 848 (FIGS. 4 and 5) on the lid filter 820 and the filter 10.

Referring to FIGS. 2, 4, and 6, low pass filter 848 (FIG. 4) on lid filter 820 (FIGS. 4 and 6) is also connected to wide area of metallization (or ground) 42 (FIG. 2) on filter 10 (FIGS. 4 and 6) via connection pad 860 (FIG. 4) on lid filter 820 which is coupled to the wide area of metallization 880 (FIG. 6) on the bottom surface 828 (FIG. 6) of the lid filter 820 which, in turn, is in contact with the metallization on the top rim 200 of the wall 120 which, in turn, is coupled to the wide area of metallization 42 on filter 10.

It is understood of course that other means or methods may be used to couple the lid filter 820 to the filter 10 including, for example, using a conductive epoxy instead of solder or using a co-firing method in which the filters 10 and 820 are fired together in a silver firing furnace after the lid filter 820 has been seated on top of the filter 10.

Figure 7:
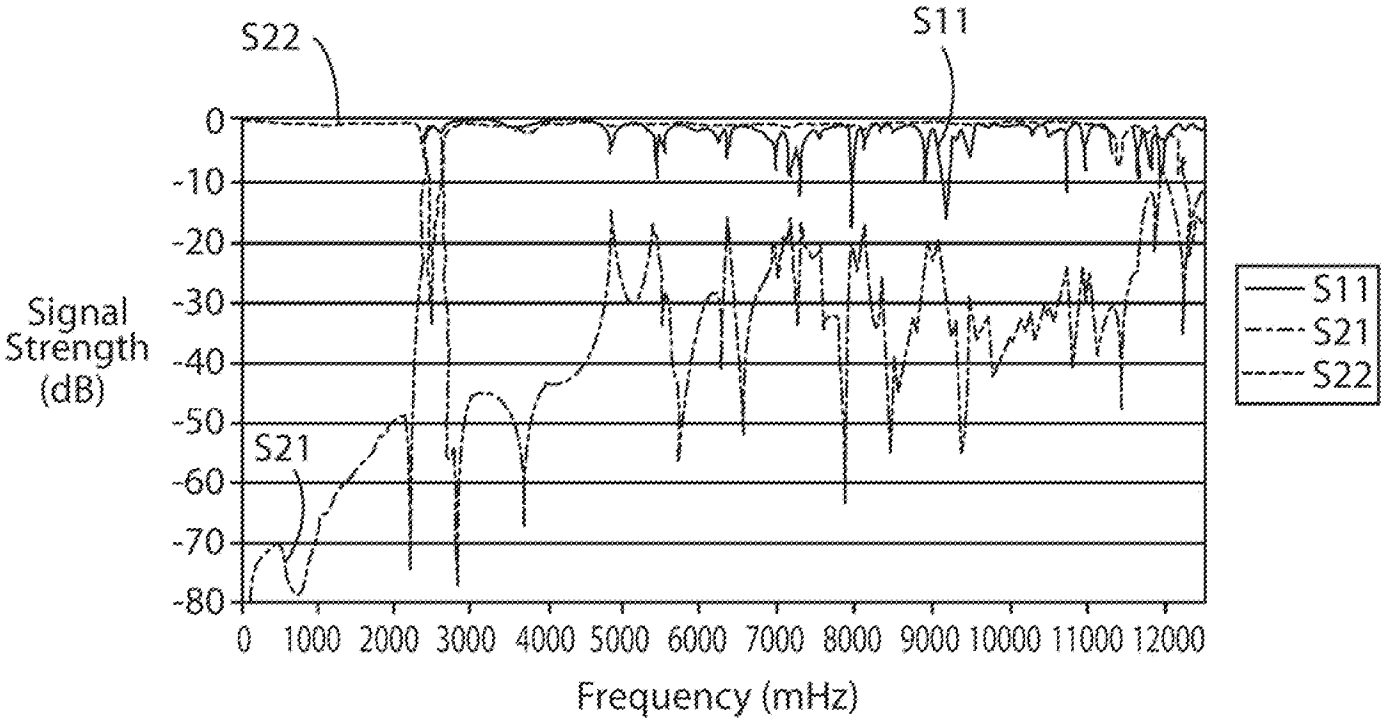
FIG. 7 is a graph of signal strength (or loss) versus frequency for the monoblock filter with lid shown in FIG. 1.

FIG. 7 is a graph of signal strength (or loss) in dB versus frequency in MHz demonstrating a specific measured performance of filter assembly 800 including low pass filter 848 in accordance with the present invention. Low pass filter 848 provides additional suppression of harmonic frequencies outside the pass band of filter 10. FIG. 7 shows a graph of return loss (S11) and insertion losses (S22) and (S21) for the frequencies measured between the input and output electrodes for a range of harmonic frequencies up to 12 GHz.

The use of filter assembly 800 has many advantages. By mounting low pass filter 848 on filter 10, space is saved on the printed circuit board to which filter 10 is mounted. With low pass filter 848 and filter 10 coupled together, the composite filter assembly 800 can be tuned as a single unit to provide an improved electrical match. Low pass filter 848 allows for filtering of harmonic frequencies in excess of 12 GHz. Other type of filters such as notch filters, band pass filters and band stop filters could also be formed on lid filter 820 using various metallization patterns. Other components may also be formed or mounted on lid 820. For example, a delay line, coupler, amplifier, LC filter or mixer could be formed on lid filter 820.

Alternative Lid Filter Embodiment

FIGS. 8, 9, and 10 depict an alternative embodiment of a lid, cover or plate filter 920 that can be mounted to monoblock filter 10 in place of the lid filter 820 to form the composite filter assembly 800 of FIG. 1.

Lid filter 920 comprises a generally elongate, parallelepiped or flat shaped rigid slab or plate comprised of a ceramic dielectric material having a desired dielectric constant. In one embodiment, the dielectric material can be a barium or neodymium ceramic with a dielectric constant of about 12 or above.

Lid filter 920 defines an outer surface with six generally rectangular sides: a top side or top surface 926 (FIG. 8); a bottom side or bottom surface 928 (FIGS. 9 and 10) that is parallel to and diametrically opposed from top surface 926; a first side or side surface 930 (FIGS. 9 and 10); a second side or side surface 932 (FIGS. 8 and 9) that is parallel to and diametrically opposed from side surface 930 (FIGS. 9 and 10); a third side or end surface 934; and a fourth side or end surface 936 (FIG. 8) that is parallel to and diametrically opposed from end surface 934.

Lid filter 920 and the respective side surfaces thereof additionally define a plurality of vertical peripheral edges 938 (FIG. 8) and a plurality of horizontal peripheral edges 939 (FIG. 8).

As shown in FIG. 8, a low pass filter 948 is defined on the top surface 926 of lid filter 920 by a surface-layer pattern 950 (FIG. 8) of electrically conductive metallized and insulative unmetallized areas or patterns.

The metallized areas are preferably a surface layer of conductive silver-containing material. Pattern 950 initially is defined by square-shaped metallized pads 951 and 952 (FIG. 8) that are generally centrally located on top surface 926. Pads 951 and 952 are spaced and separated from each other by a region of unmetallized material defining a slot 957. Pads 951 and 952 are connected together by elongated metallized arms 953, 954 and 955 (FIG. 8) that form a C-shape. Arm 954 is connected to pad 951 and arm 955 is connected to pad 952. Arm 953 is connected between arms 954 and 955. A generally rectangularly-shaped unmetallized area or region 956 (FIG. 8) is defined between arms 953, 954, 955 and pads 951 and 952. Region 956 is contiguous and perpendicular to region 957 and together define a generally T-shaped unmetallized area.

An elongate strip or line of metallization 960 (FIG. 8) extends generally centrally on the top surface 926 from arm 955 in the direction of side surface 934 in an orientation parallel to side surfaces 930 and 932; wraps over the horizontal edge 939 onto side surface 934; and is electrically connected to a wide area of metallization 980 (FIGS. 9 and 10) on bottom surface 928.

Another elongate strip or line of metallization 962 on top surface 926 extends from arm 954 initially in the direction of side surface 936 and then bends ninety degrees and extends toward side surface 932; wraps over the horizontal edge 939 onto side surface 932; and then onto the bottom surface 928 and terminates to define an RF signal input/output connection pad 963 (FIG. 10) which is surrounded on bottom surface 928 by a generally U-shaped unmetallized area or region 964 (FIGS. 9 and 10).

As described above, pattern 950 defines a wide area or pattern of metallization 980 that covers the entire bottom surface 928 except for the unmetallized region 964 surrounding the metallized connection pad 963. Wide area or pattern of metallization 980 also covers a portion of top surface 926 and side surfaces 930, 932 and 934.

Wide area of metallization 980 includes respective diametrically opposed generally rectangularly-shaped metallized areas 970 and 973 (FIG. 8) that cover a portion of top surface 926 adjacent side surface 934. Area 970 is located in the lower right corner of top surface 926 while area 973 is located in the lower left corner of top surface 926 in a diametrically opposed relationship to area 970.

Wide area of metallization 980 also includes a metallized area 971 (FIG. 9) that covers a portion of side surface 930 adjacent side surface 934 and a metallized area 974 that covers a portion of side surface 934 adjacent side surface 930. Metallized areas 971 and 974 connect area 973 to metallized area 980 on the bottom surface 928 of lid filter 920.

A metallized area 972 (FIGS. 8 and 10) covers a portion of side surface 932 adjacent side surface 934 and a metallized area 976 covers a portion of side surface 934 adjacent side surface 932. Metallized areas 972 and 976 connect area 970 to the metallized area 980 on the bottom surface 928 of lid filter 920.

Pattern 950 further defines an unmetallized area 990 (FIG. 8) that extends over portions of top surface 926, bottom surface 928, and portions of side surfaces 930, 932, 934 and 936.

Referring to FIGS. 8, 9 and 10, the lid filter 920 (FIGS. 8, 9, 10) is mounted to the monoblock filter 10 (FIG. 2) in the same manner as the lid filter 820 shown in FIG. 1, i.e., in a manner spaced from and parallel to the top surface 14 (FIG. 2) of filter 10; covering the cavity 150 (FIG. 2) of filter 10; and supported on and seated against the top metallized rim 200 (FIG. 2) of walls 110, 120, 130 and 140 (FIG. 2) of filter 10.

As with the lid filter 820, because the rim 200 of the walls 110, 120, 130, and 140 of filter 10 are metallized and portions of the bottom surface 928 (FIGS. 9 and 10) of lid filter 920 are covered by wide area of metallization 980 (FIGS. 9 and 10), lid filter 920 can be attached to filter 10 by the use of a solder material. An electrical connection between connection line 962 (FIGS. 8, 9, and 10) on lid filter 920 and electrode 224 (FIG. 2) on filter 10 can be made using the solder material.

Low pass filter 948 (FIG. 8) is thus connected at one end to electrode 224 on the post 110B (FIG. 2) of filter 10 via connection line 962 and, more specifically, the connection pad portion 963 of connection line 962 on the bottom surface 928 of lid filter 920 which is seated against and coupled to the post 110B and, more specifically, against the top rim electrode portion 227 (FIG. 2) of the electrode 224. At the other end, low pass filter 948 is connected to the wide area of metallization (or ground) 42 (FIG. 2) of filter 10 via connection line 960 (FIGS. 6, 8, 9, and 10) and, more specifically, the portion thereof which wraps around the side surface 934 (FIGS. 8, 9, 10) of lid filter 920 into contact with the wide area of metallization 980 on bottom surface 928 which, in turn, is seated over and in contact with the metallization which covers the top rim 200 of the wall 140 of the filter 10.

Lid filter 920 would also be seated against the top rim of the post 110D (FIG. 2) in a relationship with the electrode portion 213 (FIG. 2) on the top rim of post 110D is in contact with the wide area of metallization 980 on the bottom surface 928 of the lid filter 920.

Numerous variations and modifications of the monoblock and lid embodiments described above may be effected without departing from the spirit and scope of the novel features of the invention.

For example only, and referring to FIG. 2, it is understood that the core 12 and respective walls extending upwardly from the top surface 14 may be structured so that the cavity 150 occupies less than the full top surface 14 of the core 12 such as, for example, only the region surrounding the input/output posts 110B and 110D and resonator pads 60A and 60D.

It is also to be understood that no limitations with respect to the specific lid filter embodiments illustrated herein are intended or should be inferred. It is, of course, intended to cover by the appended claims all such modifications as fall within the scope of the claims.

Wall Filter

Figure 11:
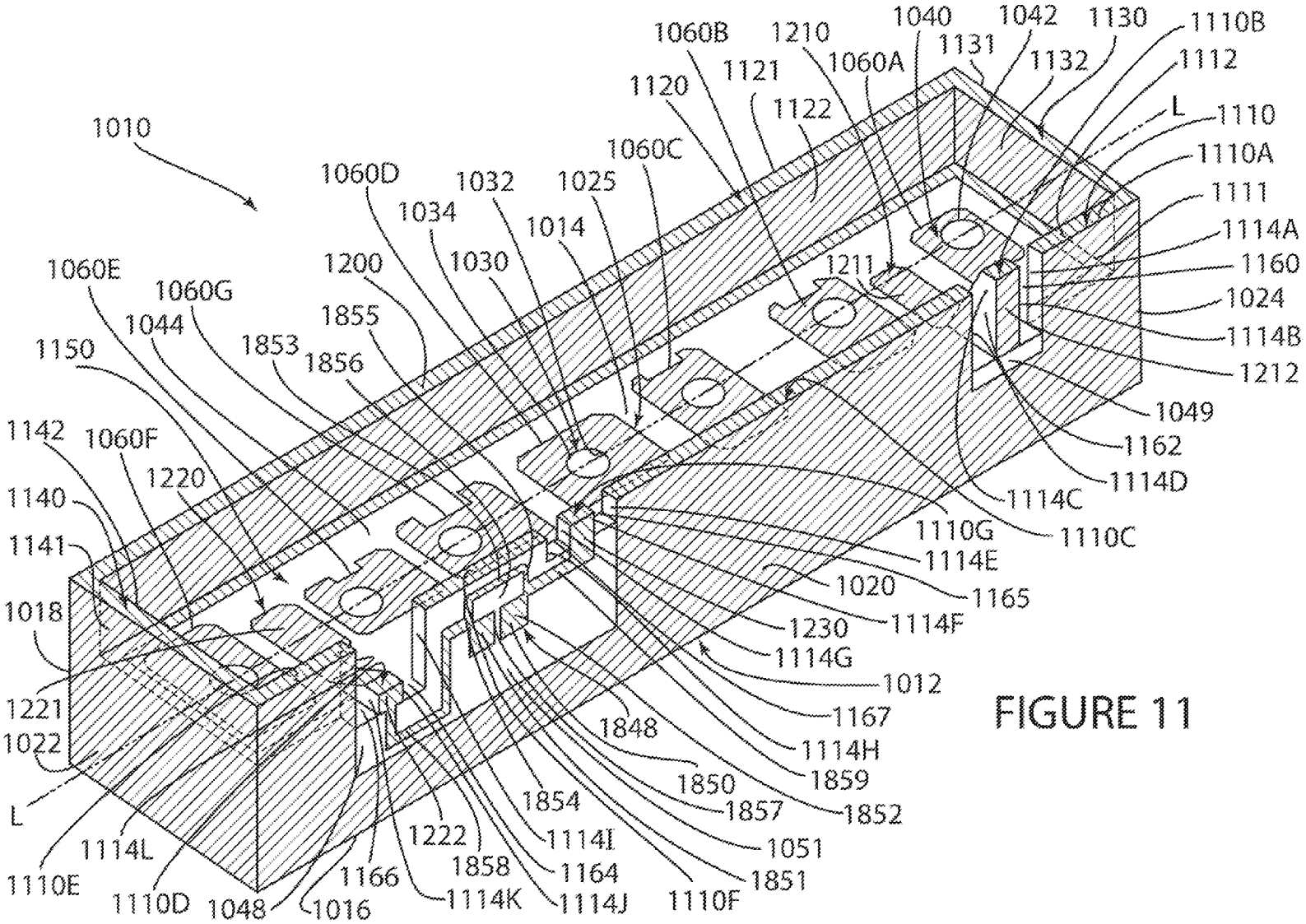
FIG. 11 is an enlarged front side perspective view of an embodiment of an RF monoblock filter according to the present invention with a low pass wall filter.
Figure 12:
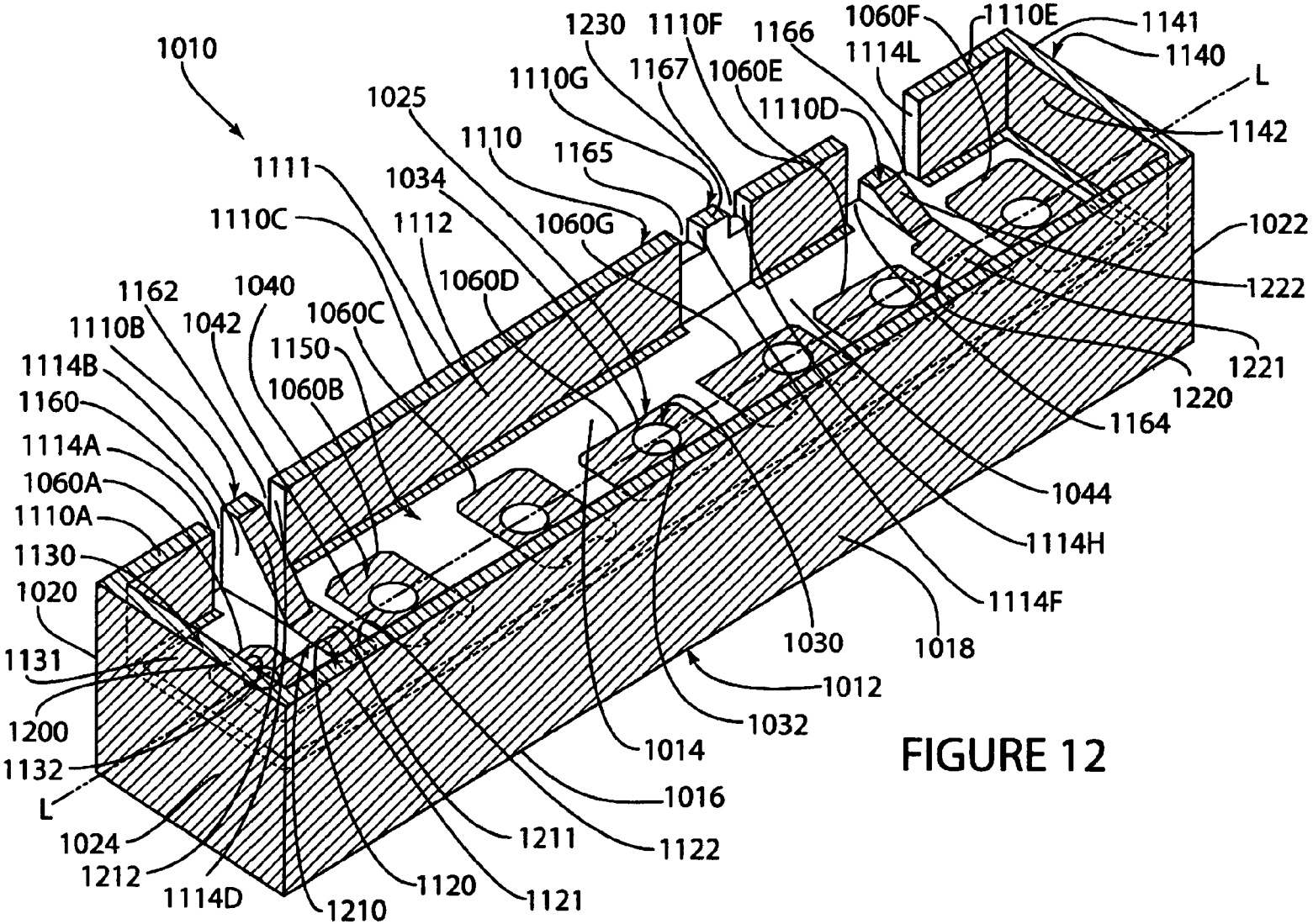
FIG. 12 is an enlarged back side perspective view of the filter shown in FIG. 11.

An embodiment of a filter assembly 1010 including a low pass wall filter 1848 instead of a low pass lid filter 848 as in the earlier embodiments is shown in FIGS. 11 and 12.

Filter 1010 is similar in structure to the filter 10 of FIG. 2 and comprises a generally elongate, parallelepiped or box-shaped rigid block or core comprised of a ceramic dielectric material 1012 having a desired dielectric constant. In one embodiment, the dielectric material can be a ceramic body with a dielectric constant of about 12 or above. Core 1012 defines a longitudinal axis L and an outer surface with six generally rectangular sides: a top side or top horizontal and longitudinally extending surface 1014; a bottom side or bottom horizontal and longitudinally extending surface 1016 that is parallel to and diametrically opposed from top surface 1014; a first side or side vertical and longitudinally extending surface 1018 that extends on a first side, and in a relationship spaced from and generally parallel to, the longitudinal axis L of the core 1012; a second side or side vertical and longitudinally extending surface 1020 that is parallel to and diametrically opposed from side surface 1018 and extends on an opposed second side of, and in a relationship spaced from and generally parallel to, the longitudinal axis L of the core 1012; a third side or end vertical surface 1022 that extends transversely between the first ends of the side surfaces 1018 and 1020 and the longitudinal axis L of the core 1012; and a fourth side or end vertical surface 1024 that is parallel to and diametrically opposed from end surface 1022 and extends transversely between the second opposed ends of the side surfaces 1018 and 1020 and the longitudinal axis L of the core.

The core 1012 and the respective side surfaces 1020, 1018, 1024, and 1022 additionally define four generally planar and vertical walls 1110, 1120, 1130 and 1140 comprised of ceramic dielectric material unitary with the ceramic dielectric material of core 1012 that extend, protrude and project upwardly and outwardly away from the respective outer peripheral edges of the top surface 1014 thereof. Walls 1110, 1120, 1130, 1140 and top surface 1014 together define a cavity 1150 in the top of the filter 1010. Walls 1110, 1120, 1130, and 1140 further together define a peripheral top rim 1200 at the top of the respective walls 1110, 1120, 1130, and 1140.

Longitudinal walls 1110 and 1120 are parallel and diametrically opposed to each other and extend on opposite sides of, and spaced from and parallel to, the longitudinal axis L of the core 1012. Transverse walls 1130 and 1140 are parallel and diametrically opposed to each other and extend in a relationship generally transverse to the walls 1110 and 1120 and generally transverse and intersecting through the longitudinal axis of the core 1012.

Wall 1110 has an outer surface 1111 and an inner surface 1112. Outer surface 1111 is co-extensive and co-planar with side surface 1020 and inner surface 1112 extends and protrudes generally normally and vertically upwardly from the top surface 1014.

Wall 1120 has an outer surface 1121 and an inner surface 1122. Outer surface 1121 is co-extensive and co-planar with side surface 1018 and inner surface 1122 is perpendicular to and extends and protrudes outwardly and upwardly from top surface 1014.

Wall 1130 has an outer surface 1131 and an inner surface 1132. Outer surface 1131 is co-extensive and co-planar with side surface 1024 and inner surface 1132 is perpendicular to and extends and protrudes outwardly and upwardly from top surface 1014.

Wall 1140 has an outer surface 1141 and an inner surface 1142. Outer surface 1141 is co-extensive and co-planar with side surface 1022 and inner surface 1142 is perpendicular to and extends and protrudes outwardly and upwardly from top surface 1014.

In the embodiment shown, each of the walls 1110, 1120, 1130, and 1140 extends the full length of the respective side surfaces 1020, 1018, 1024, and 1022.

Wall 1110 additionally defines a plurality of generally parallel and spaced-apart narrow slots 1160 and 1162; 1164 and 1166; and 1165 and 1167 that extend through wall 1110 in an orientation generally normal to top surface 1014 and define a wall 1110 with respective co-planar and vertical wall portions 1110A, 1110B, 1110C, 1110D, 1110E, 1110F, and 1110G.

An end wall portion 1110A is defined between the wall 1130 and slot 1160.

A narrow wall portion or post 1110B of ceramic dielectric material unitary with the ceramic dielectric material of core 1012 is defined between the spaced-apart slots 1160 and 1162 and protrudes and extends upwardly and outwardly from the outer peripheral edge of the top surface 1014 of filter 1010.

An elongated wall portion 1110C of ceramic dielectric material unitary with the ceramic dielectric material of core 1112 is defined between the slot 1162 and the slot 1165.

A narrow wall portion or post 1110G of ceramic dielectric material unitary with the ceramic dielectric material of core 1012 is defined between the slots 1165 and 1167 and extends upwardly and outwardly away from the outer peripheral edge of the top surface 1014 of filter 1010.

A wall portion 1110F of ceramic dielectric material unitary with the ceramic dielectric material of core 1012 is defined between the slots 1167 and 164.

A narrow wall portion or post 1110D of ceramic dielectric material unitary with the ceramic dielectric material of core 1012 is defined between the slots 1164 and 1166 and protrudes and extends outwardly and upwardly from the outer peripheral edge of the top surface 1014 of filter 1010. Post 1110D is diametrically opposed to post 1110B and is defined in an end portion of wall 1110 adjacent the wall 1140.

An end wall portion 1110E of ceramic dielectric material unitary with the ceramic dielectric material of core 1012 is defined between the wall 1140 and the slot 1166.

Thus, in the embodiment shown, the post 1110B is located between and spaced from the slots 1160 and 1162; the elongated wall portion 1110C is located between the two posts 1110B and 1110G; the slots 1165 and 1167 defining the post 1110G extend only partially downwardly into the wall 1110 from the top peripheral surface edge of the wall 1110 to a point short of the top surface 1014 to define a post 1110G and slots 1165 and 1167 which extend only partially the height of the wall 1110 and are shorter than the post 1110B and slots 1160 and 1162 that extend the full height of the wall 1110; and the post 1110D protrudes outwardly and upwardly from the top surface 1014 a distance or height less than the height of the wall 1010 and thus is located and positioned at a height and distance from the top surface 1014 less than the posts 1110B and 1110G.

The filter 1010 has a plurality of resonators 1025 defined in part by a plurality of metallized through-holes. Specifically, resonators 1025 take the form of through-holes 1030 which are defined in dielectric core 1012. Through-holes 1030 extend from and terminate in openings 1034 in top surface 1014 and openings (not shown) in bottom surface 1016. Through-holes 1030 are aligned in a spaced-apart, co-linear relationship in block 1012 such that, in the embodiment shown, through-holes 1030 are equal distances from sides 1018 and 1020 and extend in a relationship co-linear with the longitudinal axis of the core 1012. Each of through-holes 1030 is defined by an inner cylindrical metallized side-wall surface 1032.

Top surface 1014 of core 1012 additionally defines a surface-layer recessed pattern 1040 of electrically conductive metallized and insulative unmetallized areas or patterns. Pattern 1040 is defined on the top surface 1014 of core 1012 and thus defines a recessed filter pattern by virtue of its recessed location at the base of cavity 1150 in spaced relationship from and with the top rim 1200 of walls 1110, 1120, 1130, and 1140.

The metallized areas are preferably a surface-layer of conductive silver-containing material. Recessed pattern 1040 also defines a wide area or pattern of metallization 1042 that covers at least bottom surface 1016, side surfaces 1018, 1022 and 1024, and the outside surfaces 1111, 1121, 1131, and 1141 and top rim 1200 of each of the walls 1110, 1120, 1130, and 1140. Wide area of metallization 1042 also covers a portion of top surface 1014 and side surface 1020 and the interior side walls of through-holes 1030. Metallized area 1042 extends contiguously from within resonator through-holes 1030 towards both top surface 1014 and bottom surface 1016. Metallization area 1042 may also be labeled a ground electrode. Area 1042 serves to absorb or prevent transmission of off-band signals. A more detailed description of recessed pattern 1040 on top surface 1014 follows.

For example, a portion of metallized area 1042 is present in the form of resonator pads 1060A, 1060B, 1060C, 1060D, 1060E, 1060F, and 1060G which surround respective through-hole openings 1034 defined on top surface 1014. Resonator pads 1060A, 1060B, 1060C, 1060D, 1060E, 1060F, and 1060G are contiguous or connected with metallization area 1042 that extends through the respective inner surfaces 1032 of through-holes 1030. Resonator pads 1060A, 1060B, 1060C, 1060D, 1060E, 1060F, and 1060G at least partially surround the respective openings 1034 of through-holes 1030. Resonator pads 1060A, 1060B, 1060C, 1060D, 1060E, 1060F, and 1060G are shaped to have predetermined capacitive couplings to adjacent resonators and other areas of surface-layer metallization.

An unmetallized area or pattern 1044 extends over portions of top surface 1014 including respective outer peripheral portions of the top surface 1014 in the regions of the respective slots 1160, 1162, 1164, 1166, 1165, and 1167 located on opposite sides of each of the respective posts 1110B, 1110D, and 1110G, and portions of side surface 1020. Unmetallized area 1044 surrounds all of the metallized resonator pads 1060A, 1060B, 1060C, 1060D, 1060E, 1060F, and 1060G.

Unmetallized area 1044 also extends onto side wall slot portions 1114A (FIGS. 11 and 12), 1114B (FIGS. 11 and 12), 1114C (FIG. 11), 1114D (FIGS. 11 and 12), 1114E (FIG. 11), 1114F (FIGS. 11 and 12), 1114G (FIG. 11), 1114H (FIGS. 11 and 12), 1114I (FIG. 11), 1114J (FIG. 11), 1114K (FIG. 11), and 1114L (FIGS. 11 and 12). Side wall slot portions 1114B and 1114C define the opposed vertical side walls of post 1110B; side wall portions 1114F and 1114G define the opposed vertical side walls of the post 1110G; and side wall portions 1114J and 1114K define the opposed vertical side walls of the post 1110D (FIGS. 11 and 12).

Unmetallized area 1044 also defines an unmetallized area 1049 (FIG. 11) which extends onto a portion of side surface 1020 located below post 1110B and slots 1160 and 1162 in a generally rectangular shape. A similar unmetallized area 1048 (FIG. 11) extends onto a portion of side surface 1020 located below post 1110D and slots 1164 and 1166 and yet another unmetallized area 1051 (FIG. 11) surrounds the wall filter 1848 (FIG. 11) as described in more detail below. Unmetallized areas 1044, 1048, 1049, and 1051 are co-extensive or joined or coupled with each other in an electrically non-conducting relationship.

Surface-layer pattern 1040 additionally defines three isolated metallized areas or surface-layer strips of conductive material for input and output connections to the filter 1010 and the low pass wall filter 1848. An output connection area or strip or electrode 1210 and an input connection area or strip or electrode 1220 are defined on top surface 1014 and extend onto a portion of wall 1110 and side surface 1020 and, more specifically, onto the inner, rim, and outer portions or surfaces of respective input and output posts 1110D and 1110B. Electrode 1210 is located adjacent and parallel to filter side surface 1022 while electrode 1220 is located adjacent and parallel to filter side surface 1024.

Input connection area or electrode 1210 includes electrode portions 1211 and 1212. Electrode portion or finger 1211 is located on the top surface 1014 between resonator pads 1060A and 1060B extends in a generally parallel relationship to side 1024 and connects with electrode portion 1212 that is located on the sloped inner surface, the upper peripheral rim, and the exterior side wall of post 1110B. The region surrounding the electrode 1210 is unmetallized.

Output connection area or electrode 1220 includes electrode portions 1221 and 1222. Electrode portion or finger 1221 is located on the top surface 1014 between resonator pads 1060E and 1060F, extends in a generally parallel relationship to side 1022 and connects with electrode portion 1222 that is located on the interior sloped surface portion, top peripheral rim portion, and exterior side wall portion of post 1110D. The region surrounding the electrode 1220 is unmetallized.

The surface-layer pattern 1040 additionally defines another isolated metallized area or strip of conductive material or electrode 1230 on the post 1110G and, more specifically, on at least the top rim portion and exterior side surface portion of the post 1110G for output connection from the filter 1010 and the low pass filter 1848.

A low pass filter 1848 is defined on the side surface 1020 and, more specifically, on the exterior or outer surface of the wall 1110 on the side surface 1020 and, still more specifically, on the exterior or outer surface of the portion of the wall 1110 located between the posts 1110G and 1110D by a surface-layer pattern 1850 (FIG. 11) of electrically conductive metallized areas surrounded by insulative unmetallized area or region 1051.

As shown in FIG. 11, the metallized areas are preferably a surface layer of conductive silver-containing material. Pattern 1850 is defined in part by generally square-shaped metallized pads 1851 and 1852 that are spaced from each other and separated by an unmetallized slot or region 1857. A plurality of strips of conductive material define arms 1853, 1854 and 1855 that form a C-shape and connect pads 1851 and 1852 to each other. Arm 1854 is connected to pad 1851 and arm 1855 is connected to pad 1852. Arm 1853 is connected between arms 1854 and 1855. A generally rectangularly-shaped unmetallized area or region 1856 is defined in the interior region bounded by arms 1853, 1854, 1855 and pads 1851 and 1852. Region 1856 is contiguous and perpendicular to region 1857 and together define a generally T-shaped unmetallized region or area.

A strip or line of metallization 1858 connects the pad 1851 to the electrode 1222 on the exterior side wall of the post 1110D. A strip or line of metallization 1859 connects pad 1852 to the electrode 1230 on the exterior side wall of the post 1110G.

Thus, in accordance with this embodiment of the invention, an RF signal is inputted into the filter 1010 via and through the input connection area of metallization or electrode 1210 on the post 1110B; then longitudinally through the first filter defined in part by the resonators 1025 and through-holes 1030 extending longitudinally through the filter 1010; through and into the output connection area of metallization or electrode 1220 on the post 1110D; into and through the wall filter 1848 formed on the exterior of the wall portion 1110F; and then is outputted via and through the output connection area of metallization or electrode 1230 which is formed on the post 1110G.

Additionally, and although not shown in FIGS. 11 and 12, it is understood that the filter 1010 shown in FIGS. 11 and 12 is adapted for mounting to a printed circuit board of the type and in the same top surface down relationship and manner as the board and filter embodiments disclosed in co-pending U.S. patent application Ser. No. 12/316,233 now U.S. Pat. No. 8,261,714 issued on Sep. 11, 2012, the disclosure and contents of which are expressly incorporated herein by reference.

Specifically, and although not described in detail herein, it is understood that filter 1010 is adapted for mounting to a board or substrate in a top side down relationship wherein the top surface 1014 thereof is located opposite, parallel to, and spaced from the top of the board and the rim of walls 1110, 1120, 1130, and 1140 of filter 1010 are soldered to the top of the board. In this relationship, cavity 1150 is partially sealed to define an enclosure defined by the top surface 1014, the board surface, and the walls 1110, 1120, 1130, and 1140 of filter 1010. It is further noted that, in this relationship, the through-holes in filter 1010 are oriented in a relationship generally normal to the board and that the posts 1110B and 1110G and respective electrodes 1210 and 1230 would be seated on and connected to the respective RF signal input/output pads on the board.

The use of filter 1010 of the present invention with recessed top surface pattern 1040 facing and opposite the board provides improved grounding and off band signal absorption; confines the electromagnetic fields within cavity 1150; and allows the respective walls 1110, 1120, 1130, and 1140 to define shields that block external electromagnetic fields outside of the cavity 1150 from causing filter noise and interference thus improving the attenuation and zero points of the filter 1010.

Numerous variations and modifications to the monoblock and wall filter embodiment described above may be effected without departing from the spirit and scope of the novel features of the invention.

It is also to be understood that no limitations with respect to the specific wall filter embodiment illustrated herein are intended or should be inferred. It is, of course, intended to cover by the appended claims all such modifications as fall within the scope of the claims.

I claim:

1. A filter adapted to be mounted to a substrate and comprising:

a core of dielectric material including a top surface with a first pattern of areas of conductive material, first and second opposed side surfaces, and third and fourth opposed side surfaces extending between the ends of the first and second opposed side surfaces respectively;

a plurality of through-holes extending through the core and defining a plurality of respective openings in the top surface, the first pattern of areas of conductive material on the top surface surrounding at least a portion of one or more of the plurality of openings in the top surface;

at least first and second walls protruding outwardly from the top surface, each of the first and second walls including an inner surface, an outer surface, and a top rim, the first and second walls defining respective first and second shields which prevent external electromagnetic fields from causing noise and interference;

a first conductive input/output electrode on the first wall and in contact with the first pattern of areas of conductive material on the top surface of the core;

a second conductive input/output electrode on the first or second wall;

a first filter defined in part by the first pattern of areas of conductive material on the top surface of the core; and a second filter defined on one or more of the first to fourth side surfaces of the core, the filter being seated against the substrate in a relationship with the to rim of the first and second walls of the filter seated against a surface of the substrate, the top surface of the core of the filter facing and opposite the a surface of substrate, and the plurality of through-holes of the filter oriented in a relationship generally normal to the a surface of substrate.

2. A filter adapted to be mounted to a substrate and comprising:

a core of dielectric material including a top surface with a first pattern of areas of conductive material, first and second opposed side surfaces, and third and fourth opposed side surfaces extending between the ends of the first and second opposed side surfaces respectively:

at least first and second walls protruding outwardly from the top surface, each of the first and second walls including an inner surface, an outer surface, and a top rim, the first and second walls defining respective first and second shields which prevent external electromagnetic fields from causing noise and interference;

a first conductive input/output electrode on the first wall and in contact with the first pattern of areas of conductive material on the top surface of the core;

a second conductive input/output electrode on the first or second wall;

a first filter defined in part by the first pattern of areas of conductive material on the top surface of the core;

a second filter defined on one or more of the first to fourth side surfaces of the core; and a third conductive input/output electrode on the first or second wall and in contact with the first pattern of areas of conductive material on the top surface of the core, the second filter being defined by a second pattern of areas of conductive material including a first end coupled to the third conductive input/output electrode and a second end coupled to the second conductive input/output electrode.

3. The filter of claim 2, wherein each of the first, second, and third conductive input/output electrodes is defined by respective first, second, and third regions of conductive material formed on respective first, second, and third posts of dielectric material located in respective first, second, and third slots defined in the first or second walls.

4. The filter of claim 2, wherein the second and third conductive input/output electrodes are formed on the first wall, the second conductive input/output electrode being located on the first wall between the first and third conductive input/output electrodes, and the second pattern of areas of conductive material defining the second filter extending between the second and third conductive input/output electrodes.

5. The filter of claim 4, wherein each of the first, second, and third conductive input/output electrodes is defined by respective first, second, and third regions of conductive material formed on respective first, second, and third posts of dielectric material located in respective first, second, and third slots defined in the first and second walls.

6. A filter adapted to be mounted to a substrate and comprising:

a core of dielectric material including a top surface with a first pattern of areas of conductive material, first and second opposed and longitudinally extending side surfaces, and third and fourth opposed side surfaces extending transversely between the ends of the first and second opposed side surfaces respectively;

a plurality of through-holes extending through the core and defining a plurality of respective openings in the top surface, the first pattern of areas of conductive material on the top surface surrounding at least a portion of one or more of the plurality of openings in the top surface;

at least first and second walls protruding outwardly from the top surface and extending longitudinally along the first and second side surfaces respectively, each of the first and second walls including an inner surface, an outer surface, and a top rim;

a first conductive input/output electrode defined by a first strip of conductive material on the first wall and in contact with the first pattern of areas of conductive material on the top surface of the core;

a second conductive input/output electrode defined by a second strip of conductive material on the first or second wall;

a third conductive input/output electrode defined by a third strip of conductive material on the first or second wall with the second conductive input/output electrode;

a first filter defined in part by the first pattern of areas of conductive material on the top surface; and a second filter defined by a second pattern of areas of conductive material on the outer surface of the first or second wall with the second and third conductive input/output electrodes, the second pattern of areas of conductive material including a first end coupled to the second conductive input/output electrode and a second end coupled to the third conductive input/output electrode.

7. The filter of claim 6, wherein each of the first, second, and third conductive input/output electrodes is defined by respective first, second, and third posts located in respective first, second, and third slots defined in the first or second walls, the first, second, and third strips of conductive material being formed on the respective first, second, and third posts.

8. The filter of claim 6, wherein the first, second, and third input/output electrodes and the second filter are all located on the first wall and the second input/output electrode is located between the first and third input/output electrodes.

9. A filter adapted to be mounted to a substrate and comprising:

a core of dielectric material including a top surface with a first surface-layer pattern of areas of conductive material, first and second opposed and longitudinally extending side surfaces, and third and fourth opposed side surfaces extending transversely between the ends of the first and second opposed side surfaces respectively;

a plurality of through-holes extending through the core and defining a plurality of respective openings in the top surface, the first surface-layer pattern of areas of conductive material on the top surface surrounding at least a portion of one or more of the plurality of openings in the top surface;

at least first and second longitudinally extending walls protruding outwardly from the top surface in a relationship generally co-planar with the first and second side surfaces respectively, each of the first and second walls including an inner surface, an outer surface, and a top rim;

a first conductive input/output electrode defined by a first post of dielectric material defined between a first pair of slots in the first wall and including a first surface-layer strip of conductive material in contact with the first surface-layer pattern of areas of conductive material on the top surface of the core;

a second conductive input/output electrode defined by a second post of dielectric material defined between a second pair of slots defined in the first wall and including a surface-layer strip of conductive material;

a third conductive input/output electrode defined by a third post of dielectric material defined between a third pair of slots defined in the first wall and including a third surface-layer strip of conductive material in contact with the first pattern of areas of conductive material on the top surface of the core;

a first filter defined in part by the first pattern of areas of conductive material on the top surface; and a second filter defined by a second surface-layer pattern of areas of conductive material on the outer surface of the first wall, the second pattern of areas of conductive material including a first end coupled to the second conductive input/output electrode and a second end coupled to the third conductive input/output electrode.

* * * * *